US008784003B2

(12) United States Patent
Heindtel

(10) Patent No.: US 8,784,003 B2
(45) Date of Patent: Jul. 22, 2014

(54) ROAD CONSTRUCTION MACHINE PARTICULARLY A ROAD FINISHER OR ROAD FINISHER FEEDER

(75) Inventor: Michael Heindtel, Mannheim (DE)

(73) Assignee: Joseph Vogele AG, Ludwigshafen/Rhein (DE)

( * ) Notice: Subject to any disclaimer, the term of this patent is extended or adjusted under 35 U.S.C. 154(b) by 41 days.

(21) Appl. No.: 13/051,396

(22) Filed: Mar. 18, 2011

(65) Prior Publication Data

US 2011/0236131 A1 Sep. 29, 2011

(30) Foreign Application Priority Data

Mar. 23, 2010 (EP) ..... 10003083

(51) Int. Cl.
*E01C 19/22* (2006.01)
*E01C 19/18* (2006.01)
*E01C 23/14* (2006.01)

(52) U.S. Cl.
USPC ..... 404/118; 404/95; 404/108

(58) Field of Classification Search
USPC ..... 404/101, 108, 83, 95, 118
See application file for complete search history.

(56) References Cited

U.S. PATENT DOCUMENTS

| | | | | |
|---|---|---|---|---|
| 3,477,010 | A * | 11/1969 | Nard | 363/43 |
| 3,564,986 | A * | 2/1971 | Burgin | 404/84.2 |
| 5,031,086 | A * | 7/1991 | Dhyanchand et al. | 363/37 |
| 5,352,063 | A * | 10/1994 | Allen et al. | 404/84.1 |
| 6,318,928 | B1 * | 11/2001 | Swearingen | 404/72 |
| 6,334,735 | B1 * | 1/2002 | Williams et al. | 404/79 |
| 6,421,594 | B1 | 7/2002 | Erasmus | |
| 6,742,959 | B2 * | 6/2004 | Strassman | 404/95 |
| 7,050,279 | B2 * | 5/2006 | Nojima | 361/42 |
| 8,061,931 | B2 * | 11/2011 | Musil | 404/111 |
| 8,080,888 | B1 * | 12/2011 | Daley | 290/43 |

FOREIGN PATENT DOCUMENTS

| | | | |
|---|---|---|---|
| DE | 199308802 | U1 | 9/1993 |
| EP | 1036883 | A3 | 9/2000 |
| JP | 2001103506 | A * | 4/2001 |
| JP | 2001103605 | A | 4/2001 |

OTHER PUBLICATIONS

An Office Action mailed Oct. 2, 2012, which issued in corresponding Japanese Application No. 2011-059982.

* cited by examiner

*Primary Examiner* — Abigail A Risic
(74) *Attorney, Agent, or Firm* — Fish & Richardson P.C.

(57) ABSTRACT

A road construction machine, particularly a road finisher or a feeder for a road finisher, with a primary drive unit including at least one combustion engine driving a three-phase generator, and further including at least one connection means for at least one conventional alternating current standard consumer, at least one stabilized voltage supply unit is connected between the connection means and the three-phase generator, wherein the voltage supply unit provides standard mains voltage with a permanently stable frequency at the connection means independent of the speed of the combustion engine driving the three-phase generator.

2 Claims, 2 Drawing Sheets

ROAD CONSTRUCTION MACHINE PARTICULARLY A ROAD FINISHER OR ROAD FINISHER FEEDER

FIELD OF THE INVENTION

The present invention refers to a road finisher or feeder for a road finisher having a stabilized voltage supply unit containing at least one universal conversion circuit including a bridge rectifier or an intermediate circuit containing a controlled power supply.

BACKGROUND OF THE INVENTION

It is known from EP 1 036 883 A to use standard sockets that are supplied with current from a three-phase generator. Electrical standard consumers can be connected to these standard sockets. In a road finisher, standard consumers require a standard net voltage and at least substantially a constant frequency. Here, electrical consumers refers to electrical tools, appliances and devices including by way of example, a hand drill, a pressure washer, a power screwdriver or also hand lamps or power supplies for mobile telephones, laptops etc. Such standard consumers are usually not required for operation of the road construction machines, but for use on the construction site in connection with the road laying operation or in cleaning or maintenance cycles and the like, for the road construction machine. Since the three-phase generator is more or less directly driven by the combustion engine of the road finishing machine, whose speed varies depending on the state of load, the frequency of the current supplied by the three-phase generator also varies. In the normal case, a frequency of approx. 50 Hz is reached at the three-phase generator and the sockets only at low engine speed, e.g. in the case of running at idle or when the idle speed is raised so that only in this tight engine speed range can conventional standard consumers be operated. If the engine speed is increased with respect to this speed range in which the standard consumers can be used, the output voltage of the three-phase generator is usually stabilized, however, the frequency rises in proportion to the speed. This increase in frequency would cause damage to the electrical standard consumers. Thus, it is known to activate the sockets on the road finisher only for the useable frequency for standard consumers, but to switch it off if the frequency becomes too low or too high. This means quite a considerable technical effort for the activation and deactivation of the standard sockets and bears the fundamental disadvantage of no longer being able to operate such standard consumers if the combustion engine does not run at a predetermined low speed. During normal working operation, the combustion engine runs at full load usually with a too high speed for electrical standard consumers so that they can then not be used. However, there is considerable need for permanently running certain electrical standard consumers at the road construction machine and not only in a low load state of the combustion engine. Although this requirement can be fulfilled in that no "conventional" electrical consumers are connected but only special consumers that can cope with high or varying frequencies, wherein special plug connectors are also used. However, this means a considerable additional expenditure. As an alternative, it is possible to use the usually provided 24-Volt on-board supply system of the road construction machine, i.e. supplied by a battery, for some electrical standard consumers. However, the 24-Volt on-board supply system is heavily loaded and rapidly drawn down by permanently or frequently switched-on standard consumers.

In a wheel loader known from JP 2001 10 36 05 A a converter must be connected to a supply line using electrical wheel motors, which can be operated independent of frequency and which are connected to a generator. A controlled transformer is connected downstream of the converter to which a socket is connected in which a predetermined frequency and a predetermined voltage is provided. Both the converter as well as the transformer are controlled separately by a central control device. The downstream connected transformer serves for generating a potential separation so that special consumers can be operated at the socket.

OBJECT OF THE INVENTION

The object of the present invention is to provide a road finisher or feeder for a road finisher of the above-mentioned type, in which the given high electrical power efficiency of the three-phase generator can also be utilized for the permanent or on-demand operation of electrical standard consumers regardless of the speed of the combustion engine, i.e. the operation of "conventional" standard consumers that need a constant frequency of the voltage is independent of the engine speed of the road finishing machine.

SUMMARY OF THE INVENTION

The object is solved by the road finisher of the present invention.

Several connection means are for instance arranged in a distributed manner at the road finisher and/or on a paving screed of the road finisher, said connection means being supplied with supply voltage of a constant frequency via the central voltage supply unit or also several voltage supply units. In this manner electrical consumers can selectively be connected from different positions on the road construction machine and can be used in a more optimum manner. The stabilized voltage supply unit provides a purposeful supply voltage permanently with a constant frequency, independent of the speed of the combustion engine or the working speed of the three-phase generator for the connection means provided for electrical standard consumers. Thus, all conventional electrical consumers which require a certain supply voltage and most of all a substantially stable constant frequency can permanently or frequently be used or they can be used on demand. Such electrical standard consumers are for instance electronic tools, illumination means, gas discharge lighting balloons, power supplies for mobile telephones or laptops and the like. The operation of these electrical standard consumers does not lead to an inappropriate load of the 24-Volt on-board supply system. Exotic plug connectors are not required. The large power efficiency reserve of the three-phase generator is utilized in a universal manner. The additional technical expenditure for the voltage supply unit must be equated to the technical expenditure for frequency-dependent connection options that can be switched off or for frequency-independently operable electrical consumers. However, the operating personnel can use cost-effective means at and in the environment of the road construction machine on the construction site in a manner as if a standard mains exists. The stabilized power supply unit comprises at least one universal inverter circuit by means of which from the AC voltage generated by the three-phase generator of variable frequency and eventually even varying, quasi in an intermediate circuit an intermediate voltage and therefrom the required mains voltage having stabilized frequency can be generated. The intermediate circuit includes bridge rectifiers or a controlled switching power supply. Stable frequency in this case means a frequency, which does possibly not yet exist when starting the internal combustion engine, but which at least sets in if the combustion engine runs at its idle speed or on a low speed level that is conventional in such road construction machines. The frequency is then kept constant up to the maximum speed or to the speed corresponding to the full load state.

The universal inverter means can be adapted to the desired mains voltage or frequency. The mains voltage is for instance selected depending on country-specific requirements or the electrical standard consumers to be used with for instance 110 Volt, 220 to 240 Volt or 400 Volt, at a frequency of for instance 50 Hz or 60 Hz.

In a useful embodiment the connection means comprises at least one clamp and/or one standard socket, preferably a grounded socket. Since the correct frequency is constantly ensured over the stabilized voltage supply unit, an electrical standard consumer can also permanently be connected to a clamp, e.g. an illumination system, and the standard socket, particularly the grounded socket, can be used any time for connecting the respectively required standard consumer and independent of the speed of the running combustion engine. In order to be able to use several electrical standard consumers in parallel, at least one clamp battery with a plurality of connection options and/or one standard socket battery, with a plurality of grounded sockets usable in parallel can be provided.

The voltage supply unit can directly be connected to the three-phase generator or via an interconnected protection system. It is also possible to separately protect the voltage supply unit and to connect it to a supply line of a further electrical consumer of the road finisher or feeder, or to an already protected supply line to such a consumer. This reduces at a high operational safety the expenditure in the circuit of the road construction machine, since the voltage supply unit can be placed and interconnected at a suitable position.

A road finisher or feeder and/or construction site illumination system can be connected in a hard-wired manner to the connection means, wherein this illumination system is equipped with standard consumers which require a stable frequency and a predetermined mains voltage.

DESCRIPTION OF DRAWINGS

The subject matter of the invention will be explained in detail by means of the drawings.

DETAILED DESCRIPTION

Figure 1:
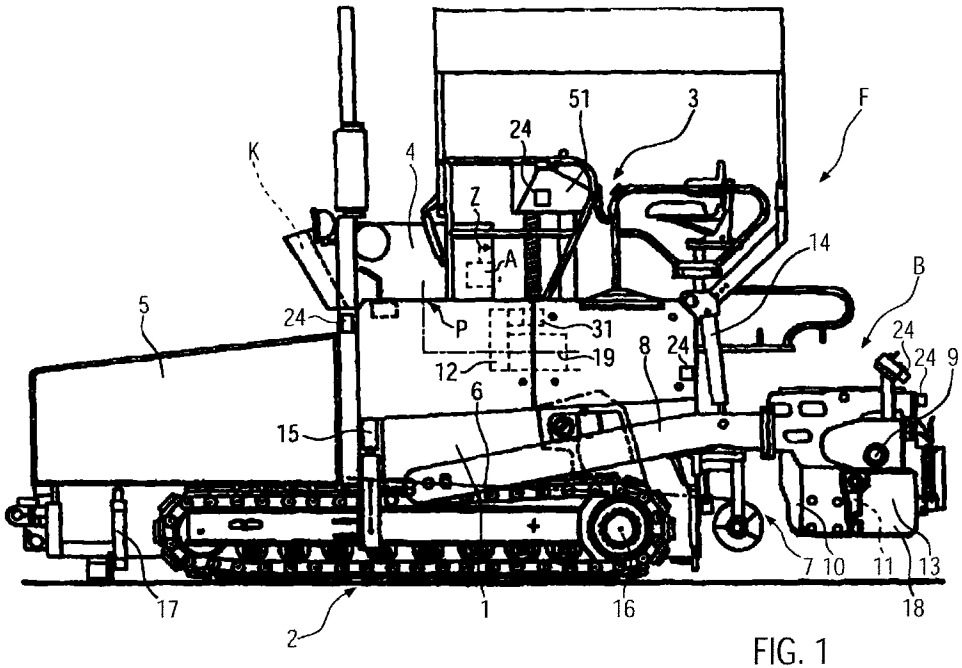
FIG. 1 shows a diagrammatical side view of a road finisher.

FIG. 1 shows a road finisher F for installing cover layers of bituminous or concrete material. As an alternative, this could be a feeder of a road finisher, which is used for supplying at least one road finisher and which has a similar design as a road finisher.

The road finisher being the construction machine F has a base frame 1 with a chassis 2 (crawler chassis, as shown, or wheel chassis, not shown). A driver's cabin 3 is mounted on the base frame 1, wherein a combustion engine 4, e.g. a diesel engine, and a cooling system K are located as primary drive unit P at the driver's cabin. A stock hopper 5 is arranged in the front part of the base frame. A material conveying means 6, e.g. at least one scraper conveyor or a screw conveyor extend from the stock hopper to a material distribution means 7 arranged at the rear end, e.g. to one or several augers.

Cantilevers 8 are laterally articulated on the base frame 1 on which the paving screed B is mounted in which amongst others, besides compression units that are not emphasized in detail, tamping means 10, possibly pressing elements 11, vibration means 13, at least one electrical heating means 18 and with adjustment means 9 can be arranged. The cantilevers 8 can be lifted via rear lifting cylinders 14 and they are adjustable at their articulations e.g. for leveling the paving screed B by means of leveling cylinders 15. A drive unit 16, e.g. a hydrostatic drive unit is provided in the drive unit at each side. Side walls of the hopper 5 can be adjusted by adjustment cylinders 17. In the driver's cabin a control panel 5 is accommodated together with a control, not defined any closer, for the individual secondary drives of the road finisher F.

The combustion engine 4 drives a three-phase generator 19 for instance via a pump transfer gear. The pump transfer gear can also drive several hydraulic pumps 31 which serve for supplying hydrostatic secondary drives in the road finisher F. Furthermore, connection means 24 for electrical standard consumers (not shown) are provided at a central portion or, as indicated, in a distributed manner on the road finisher F and/or on the paving screed B for electrical standard consumers or conventional consumers, which during operation require a predetermined mains voltage and a stable frequency. The connection means 24 are electrically supplied by the three-phase generator 19 (see FIG. 2) with a selectable mains voltage and a frequency that is permanently at least substantially stable or constant.

Figure 2:
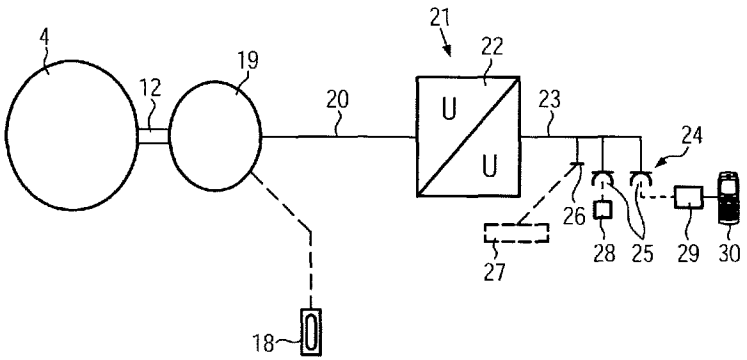
FIG. 2 shows a diagrammatical block diagram to show a connection means for electrical standard consumers.

FIG. 2 schematically shows how the combustion engine 4, e.g. the diesel engine, drives the three-phase generator 19 through a drive connection (e.g. the pump transfer gear 12 of FIG. 1) in a manner that the working speed of the three-phase generator 19 permanently corresponds either to the speed of the combustion engine or is proportional thereto. The electrical heating means 18 is for instance permanently connected to the three-phase generator 19, in which said heating means electrical heating rods (not shown) can be provided, which can possibly be operable independent of frequency. The frequency generated by the three-phase generator 19 varies between approx. 40 Hz to 140 Hz. The voltage can also vary. A voltage lowering is for instance possible by a CAN bus provided. Furthermore, a supply line 20 leads from the three-phase generator 19 to a stabilized voltage supply unit 21 (in the road finisher F at least one such stabilized voltage supply unit 21 is installed at a suitable position), which comprises a conversion circuit 22 which generates an intermediate voltage from the alternating voltage provided by the three-phase generator 19 (voltage level and frequency are irrelevant and variable), e.g. in an intermediate circuit, e.g. by bridge rectifiers or a controlled switching power supply. A stable mains voltage is generated from an intermediate voltage, e.g. corresponding to the local network, with a substantially constant voltage value and a substantially constant frequency. Several clamps 26 or standard sockets 25, preferably grounded sockets, are connected in parallel to the stabilized voltage supply unit 21 e.g. via a connection line 23 in the connection line 24. One clamp battery each and/or standard socket battery can be provided in the connection means 24. An illumination system 27 as an electrical standard consumer is fixedly connected to the clamp 26 shown in FIG. 2, said illumination system can be the illumination system of the road finisher and/or of a construction site. This is for instance a 230 Volt illumination system, or several gas discharge lighting balloons or the like are fixedly connected. A cooling box 28 or an electronic tool such as a screwdriver, a high-pressure washer or a drilling machine can be connected for instance to the standard sockets 25, which are utilized for secondary works at or in the area of the road finisher. A power supply 29 for a mobile telephone or a laptop 30 is as an example of an electrical standard consumer connected to a further standard socket.

The mains voltage can be approx. 10 Volt, or 220 to 240 Volt or also 400 Volt, depending on the respective requirement, wherein the frequency lies at approx. 50 Hz or at 60 Hz and is kept permanently stable.

A 24-Volt on-board mains Z is also indicated in the road finisher as an example of a road construction machine F in FIG. 1, said on-board mains being supplied by a battery A, which in turn is charged by the three-phase generator 19 or as an alternative by a light machine that is not shown via a controller. Instead of one or several mobile telephones, a laptop or the like could be connected. The connection means 24 is permanently activated independent of the speed of the combustion engine and is possibly only deactivated during start of the combustion engine 4.

The connection means 24 or a stabilized voltage supply unit 21 can have its own safety system or it can be connected to a safety system provided at the three-phase generator 19, or it can be connected to a possibly secured supply line to a further consumer of the road finisher, e.g. to the supply line to the electrical heating means 18.

What is claimed is:

1. A road finisher or a feeder for a road finisher with a primary drive unit, comprising at least one electrical heating apparatus operable with alternating voltage with varying frequency, a combustion engine driving at least one three-phase generator for supplying the at least one electrical heating apparatus with alternating voltage with varying frequency, and at least one connection means for at least one conventional alternating current consumer, a stabilized voltage supply unit having at least one universal conversion circuit including a bridge rectifier or an intermediate circuit containing a controlled power supply, respectively for first generating an intermediate voltage and secondly generating a standard mains voltage with a permanently stable frequency from the intermediate voltage, the stabilized voltage supply unit being connected between the connection means and the three-phase generator to provide the standard mains voltage at the connection means which is connected via a connection line to the universal conversion circuit, the voltage supply unit being connected directly to the three-phase generator or to a securing system or a secured supply line of the at least one electrical heating apparatus.

2. A road finisher or feeder for a road finisher as claimed in claim 1, wherein the connection means comprises at least one grounded socket.

* * * * *